US005513747A

United States Patent [19]

Hayao

[11] Patent Number: 5,513,747

[45] Date of Patent: May 7, 1996

[54] INK REFILL KIT

[75] Inventor: Sakae Hayao, Chatsworth, Calif.

[73] Assignee: Sercomp Corporation, Chatsworth, Calif.

[21] Appl. No.: 387,975

[22] Filed: Jan. 27, 1995

[51] Int. Cl.[6] ..... B65D 85/38

[52] U.S. Cl. ..... 206/232; 206/460; 206/723

[58] Field of Search ..... 206/232, 373, 206/460, 471, 722, 723; 434/439

[56] References Cited

U.S. PATENT DOCUMENTS

| | | | |
|---|---|---|---|
| 2,142,618 | 1/1939 | Schreter | 206/232 |
| 5,074,418 | 12/1991 | Buan et al. | 206/471 |
| 5,168,996 | 12/1992 | Johnson | 206/373 |
| 5,231,416 | 7/1993 | Terasawa et al. | 206/723 |
| 5,231,425 | 7/1993 | Masuda et al. | 206/723 |
| 5,244,087 | 9/1993 | Hikake et al. | 206/471 |
| 5,251,745 | 10/1993 | Repp et al. | 206/232 |
| 5,373,936 | 12/1994 | Kawai et al. | 206/723 |

*Primary Examiner*—Jimmy G. Foster
*Attorney, Agent, or Firm*—Koda and Androlia

[57] ABSTRACT

An ink refill kit comprising an instruction sheet and an ink cartridge holding box. The ink cartridge holding box is placed in a working area which is located at the center of the instruction sheet, and an instruction area describing steps to be taken for refilling ink printed around the working area. The ink cartridge holding box includes an adhesive material for securely holding the ink cartridge upright and closing the bottom hole of the ink cartridge.

9 Claims, 1 Drawing Sheet

INK REFILL KIT

BACKGROUND OF THE INVENTION

1. Field of the Invention

The present invention relates to an ink refill kit and more particularly to an ink refill kit used for refilling ink into a used empty ink cartridge for computer printers.

2. Prior Art

When the ink in an ink cartridge used for a computer printer is used up, a new ink cartridge is set in the printer. Recently, however, it has started to be practiced that an empty ink cartridge is refilled with ink so that the refilled ink cartridge can be used repeatedly for several times.

The refilling of ink into ink cartridges is currently performed in several different ways. One of them is that an empty cartridge is set in a cartridge holding casing that has a top cover so that the empty ink cartridge is entirely inside the casing for receiving the ink. Another way of refilling ink is to use a refill adapter. One of the refill adapters invented by the inventor of the present application has been filed in the United States Patent Office under the Ser. No. 08/327,280. When this refill adapter is used, an empty cartridge is held by hand and the adapter is placed on the cartridge, and then an ink tube is set on the adapter upside down so that the ink in the tube flows into the cartridge.

When the ink refilling is performed, the user looks at the manual that shows the steps to be taken. However, manuals usually merely lists the steps to be taken, and the intended work or ink refilling is performed with the empty cartridge positioned away from the manual. Work under these conditions is inconvenient and takes up space.

SUMMARY OF THE INVENTION

Accordingly, it is a primary object of the present invention to provide an ink refill kit with which ink refilling can be done efficiently and cleanly.

The above and other objects of the present invention is accomplished by a unique structure for an ink refill kit that comprises an instruction sheet and a cartridge holding box in which the instruction sheet includes a central working area and an instruction area which surrounds the central working area with the instruction area divided into several sections containing descriptions and illustrations of steps to refill ink indicated, and the cartridge holding box which is placed in the central working area includes a cartridge holding means comprising an opening and an adhesive that are provided on a platform provided above the bottom of the cartridge holding box.

With this structure, the holding box with the ink cartridge is placed in the central working area of the instruction sheet, and an empty cartridge is placed in the cartridge holding box in a positionally secured fashion, and then the ink refilling is performed in this centrally located working area following the description and illustration indicative of the steps to be taken that are shown around the central working area. Thus, the ink refill can be done easily and efficiently with an additional advantage that the area around the refilling job can be kept clean.

DETAILED DESCRIPTION OF THE INVENTION

Figure 1:
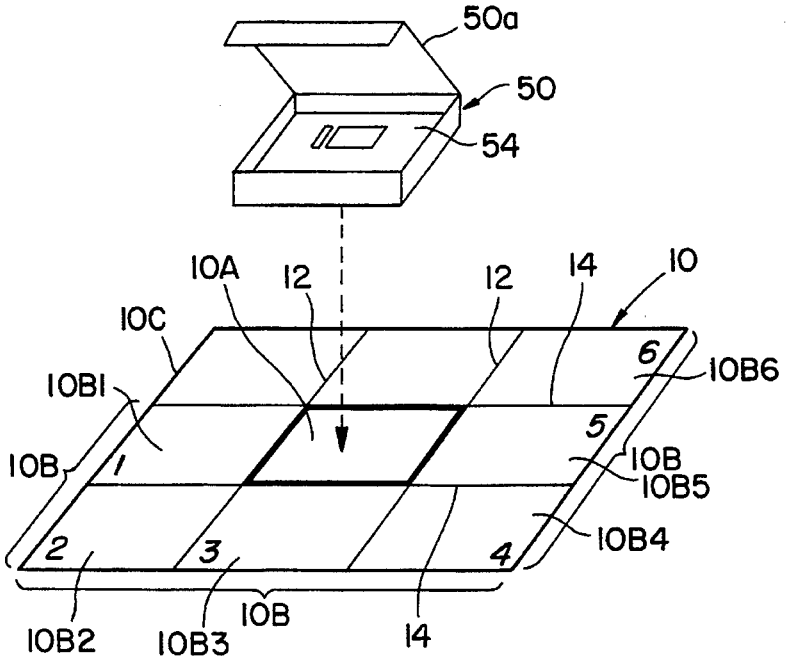
FIG. 1 shows components of the ink refill kit of the present invention which are an instruction sheet and a cartridge holding box.
Figure 2:
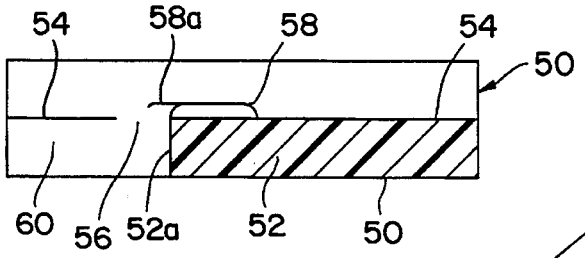
FIG. 2 shows a cross section of the cartridge holding box.

Referring now to FIG. 1, the ink refill kit substantially includes an instruction sheet 10 and an ink cartridge holding box 50.

The instruction sheet 10 comprises a base sheet 10C printed with a working area 10A and an instruction area 10B. The instruction sheet 10 is made of durable paper, but it can be made of any material including vinyl and plastics that have a certain strength. The instruction sheet 10 can be coated with a water-proof substance for a better durability and for keeping ink from soaking thereinto.

The working area 10A is located at the center of the instruction sheet 10, which is, in this embodiment, a rectangular shape. The instruction sheet 10 can be in any shape including a square, circle, etc. The working area 10A at the center is of a like figure to the cartridge holding box 50 and defined by thick surrounding lines which are portions of two longitudinal lines 12 and two lateral lines 14, and an intended work, an ink refilling in this embodiment, is performed in this working area 10A.

The instruction area 10B is provided so as to encircle or surround the working area 10A. The instruction area 10B is divided into a plurality of sections 10B1 through 10B6 by the longitudinal and lateral lines 12 and 14 so that each step to be taken in the ink refilling is described in each one of these sections in words and illustrations. In addition, these sections 10B1 through 10B6 are preferably printed with consecutive numbers from 1 through 6 counter-clockwise which represent the steps to be taken in this order. Alternately, the steps could also be printed clockwise.

The instruction sheet 10 can be folded along the lines 12 and 14 by using these lines as a crease. In other words, the sheet 10 is folded along the longitudinal lines 12 first and then along the lateral lines 14 so that the instruction sheet 10 can be put into the size of the cartridge holding box 50, thus being stored in the box 50 along with other ink refill components such as the adapter and a priming pump.

In this embodiment, each of the six (6) sections are given the following instruction statements:

In section 10B1: Peel off protective film.

In section 10B2: Firmly press used cartridge into stand.

In section 10B3: Firmly press refill adapter onto used cartridge . . .

In section 10B4: Insert ink pack into refill adapter in a straight downward motion . . .

In section 10B5: Insert priming pump into the vent hole . . .

In section 10B6: Wipe off excess ink . . .

The cartridge holding box 50 is made of durable paper and has a cover 50*a*. A bottom 50*b* of the holding box 50 is securely provided with a supporting block 52 which is size-wise about one half of the bottom 52*b*. The supporting block 52 is made of, for example, a cotton that is formed into a relatively flat block shape. In other words, it is preferable to form the supporting block 52 with a liquid absorbent material so that any spilled ink can be absorbed by the supporting block 52.

Figure 3:
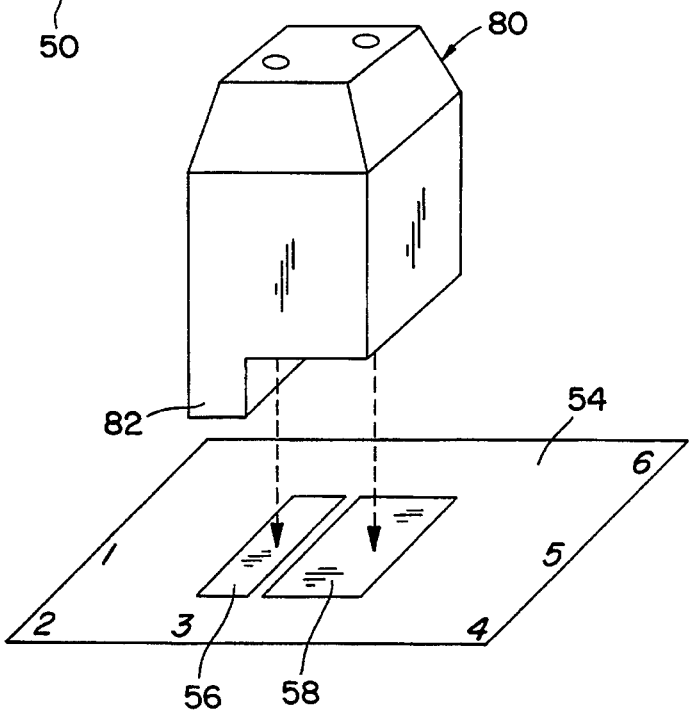
FIG. 3 is a perspective view showing the relationship between the platform of the cartridge holding box and the ink cartridge.

On this supporting block 52, a platform 54 which is as large in size as the bottom 50*b* is provided. An empty space 60 is left on one side underneath of the platform 54. The platform 54 is provided with a rectangular opening 56 that opens into the empty space 60. The opening 56 is substantially the same as or slightly larger than the bottom projected portion 82 of an ink cartridge 80 that is shown in FIG. 3.

An adhesive 58, which makes a cartridge holding means along with the opening 56, is provided next to the opening 56 so as to be located above the inner end portion 52*a* of the supporting block 52. The adhesive 58 is a self adhesive tacky substance or pressure sensitive contact adhesive and covered by a removable thin sheet of plastic film 58*a*.

The platform 54 is printed with Numbers 1 through 6 around the opening 56 and holding means 58. The Numbers 1 though 6 positionally correspond to the numbers printed in the sections 10B1 through 10B6 printed on the instruction sheet 10. In other words, the Numbers 1 through 6 are printed, like the sections 10B1 through 10B6, counter-clockwise so that when the cartridge holding box 50 is placed in the working area 10A of the instruction sheet 10, the Numbers 1 through 6 of the box 50 match the numbers of the sections 10B1 through 10B6 of the instruction sheet 10.

With the structure described above, when the ink-refill is performed, the folded and stored instruction sheet 10 is taken out of the cartridge holding box 50 and extended. Then, the cartridge holding box 50 is placed in the working area 10A of the thus extended instruction sheet 10.

When the cartridge holding box 50 is in place, the Numbers 1 through 6 printed on the platform 54 of the holding box 50 and the numbers 1 through 6 printed on the instruction sheet 10 are matched, and an empty ink cartridge is set inside the cartridge holding box 50.

When the cartridge 80 is placed in the box 50, the plastic film 58*a* is first removed from the holding means 58, and the projected portion 82 of the cartridge 80 is pushed into the rectangular opening 56 of the platform 54 of the cartridge holding box 50. When the rectangular portion 82 is pushed, the bottom of the cartridge 80 is pressed onto the adhesive 58 of the platform 54. As a result, the ink cartridge 80 can stand upright by the opening 56 and the adhesive 58, which make a holding means, so that the cartridge 80 is firmly held inside the cartridge holding box 50 without moving horizontally nor vertically. When the cartridge 80 is thus firmly held by the holding means or by the opening 56 and the adhesive 58, the supply hole (not shown) opened in the bottom of the cartridge 80 for supplying the ink to the printer is tightly closed by the adhesive 58 which is a tacky substance. Thus, the holding means not only firmly holds the ink cartridge 80 upright but also securely closes the ink outlet hole of the cartridge 80, thus preventing leakage of the ink.

Then, the user follows the steps shown in the instruction area 10B in the order of the given numbers.

As seen from the above, according to the present invention, since the intended work which is for refilling an empty ink cartridge with ink is done at the center of the instruction sheet, and the ink cartridge is kept upright, refilling of ink can be done easily, and the surrounding area will not be contaminated by scattered and splashed ink. In addition, each step of the intended work is shown around where the intend work is performed; accordingly, such a work can be performed smoothly without skipping steps.

I claim:

1. An ink refill kit for refilling ink into an empty ink cartridge comprising an instruction sheet and an ink cartridge holding box wherein:

said instruction sheet is provided with a working area at substantially a center of said instruction sheet and an instruction area surrounds said working area, said instruction area being divided into a plurality of sections which are printed with consecutive numbers indicative of an order of steps to be taken in refilling ink and with instruction statements and illustrations of said steps; and said ink cartridge holding box is provided with a platform over a bottom of said holding box, said platform being provided with a cartridge holding means comprising an opening and an adhesive, said opening receiving a projected portion of said ink cartridge and said adhesive securely holding a flat bottom of said ink cartridge.

2. An ink refill kit according to claim 1, wherein said working area and said instruction area of said instruction sheet are defined by lines crossing in longitudinal and lateral directions so that said instruction sheet is folded along said lines and stored in said cartridge holding box.

3. An ink refill kit according to claim 1, wherein said adhesive is covered by a removable thin plastic sheet.

4. An ink refill kit according to claim 1, wherein said adhesive is a pressure sensitive contact adhesive.

5. An ink refill kit according to claim 1, wherein said adhesive is a self adhesive tacky substance.

6. An ink refill kit according to claim 1, wherein said platform of said ink cartridge is printed with consecutive numbers that correspond to said consecutive numbers printed in said instruction area of said instruction sheet.

7. An ink refill kit according to claim 1, wherein said instruction sheet is coated with a water-proof substance.

8. An ink refill kit according to claim 1, wherein said platform is provided on a supporting block that is made of liquid absorbent material and secured to a bottom of said cartridge holding box.

9. An ink refill kit according to claim 8, wherein said absorbent material is a cotton.

* * * * *